United States Patent [19]

Fujimoto et al.

[11] Patent Number: 4,693,305

[45] Date of Patent: Sep. 15, 1987

[54] SYSTEM FOR CONTROLLING FLUID FLOW IN A TUBE OF A HEAT EXCHANGER

[75] Inventors: Masakazu Fujimoto; Kikuo Kogaito, both of Tokyo, Japan

[73] Assignee: Ebara Corporation, Japan

[21] Appl. No.: 692,850

[22] Filed: Jan. 18, 1985

[51] Int. Cl.[4] ..... F28G 1/02; F28G 1/12

[52] U.S. Cl. ..... 165/95; 165/97; 134/8

[58] Field of Search ..... 165/95, 97; 105/3.51, 105/104.06 R; 134/8

[56] References Cited

U.S. PATENT DOCUMENTS

| | | | |
|---|---|---|---|
| 1,325,348 | 12/1919 | Bowman | 15/104.06 R |
| 1,547,440 | 7/1925 | Penn | 15/104.06 R |
| 3,057,758 | 10/1962 | Walker et al. | 134/8 |
| 3,319,710 | 5/1967 | Heeren et al. | 15/104.06 R |
| 3,412,786 | 11/1968 | Taylor | 165/95 X |
| 3,451,091 | 6/1969 | Wallace | 15/104.06 R |
| 3,473,961 | 10/1969 | Heeren et al. | 134/8 |
| 4,124,065 | 11/1978 | Leitner et al. | 134/8 X |
| 4,143,702 | 3/1979 | Barr, Jr. | 165/97 X |
| 4,269,264 | 5/1981 | Goeldner | 165/95 |
| 4,390,058 | 6/1983 | Otake et al. | 165/95 X |
| 4,476,917 | 10/1984 | Otake et al. | 165/95 X |
| 4,583,586 | 4/1986 | Fujimoto et al. | 165/95 |
| 4,606,403 | 8/1986 | Fujimoto et al. | 15/3.51 X |
| 4,617,987 | 10/1986 | Fujimoto et al. | 15/3.51 X |

FOREIGN PATENT DOCUMENTS

| | | | |
|---|---|---|---|
| 1159818 | 1/1984 | Canada | 165/95 |
| 0056204 | 5/1977 | Japan | 165/97 |
| 0066699 | 6/1981 | Japan | 165/97 |
| 0009493 | 1/1984 | Japan | 165/95 |

OTHER PUBLICATIONS

"Cleaning Arrangement for Heat Exchanger Tubes" Research Disclosure, Jan. 1982, No. 213, p. 475–477.

*Primary Examiner*—Albert W. Davis, Jr.
*Assistant Examiner*—Randolph A. Smith
*Attorney, Agent, or Firm*—Steinberg & Raskin

[57] ABSTRACT

System and method for controlling flow rate of a fluid through a tube of a heat exchanger, such as through condenser or evaporator tubes disposed within a respective condenser or evaporator in a refrigerator. Flow direction of fluid through the tube is reversed, e.g. by way of a directional control valve, which can move a brush disposed within the tube therethrough, to automatically clean the same. The system and method is capable of increasing the flow rate of the fluid through the tube at or during the flow directional change, to ensure, e.g., that a minimum velocity required to move the cleaning brush through the tube is reached.

12 Claims, 10 Drawing Figures

SYSTEM FOR CONTROLLING FLUID FLOW IN A TUBE OF A HEAT EXCHANGER

BACKGROUND OF THE INVENTION

The present invention is directed to a system and method for controlling fluid flow within a tube of a heat exchanger. More particularly, the present invention relates to a system and method for controlling flow rate of fluid in a heat exchanger where the flow direction of fluid therethrough is switched or reversed, in order to cause a brush mounted within the tube to move therealong, thus cleaning the interior of the same.

In a heat exchanger of the shell-and-tube type which has been widely known in the art, cleaning of a tube therein is carried out by operating a directional control valve for switching or reversing flow direction of fluid supplied to the heat exchanger tubes. This causes a brush that is received in certain brush capturing devices or chambers disposed at opposite ends of the tube, to move therealong, thus automatically cleaning the interior of the tube.

However, such a conventional cleaning system is disadvantageous in that flow rate or velocity of fluid within the tube is decreased depending upon operating conditions, to such a degree that the brush fails to move along the tube when the flow direction of fluid therein is reversed by the directional control valve. Thus, cleaning of the interior of the tube is rendered virtually impossible. Such decrease of flow rate within the tube also causes the brush to block the interior of the tube when it stagnates therein. This results in problems such as failure of heat transfer, e.g. overheating, along with deterioration of the fluid flowing therewithin.

Additionally, a conventional refrigerator having an automatic tube cleaning device incorporated therein, in which a heat exchanger as described above is utilized, is adapted to detect the load of the refrigerator (e.g. the load of fluid to be cooled within the evaporator such as cool water, the temperature of this cool water during the operation of manufacturing the same, or the load of fluid to be heated, e.g. hot water from a condenser in a heat pump during the operation of manufacturing hot water) without controlling the flow rate of the heating or cooling medium (e.g. the cooling or heating water), or without controlling the flow rate of the cool water itself, and then control the capacity of the refrigerator based upon a signal from the load thereof.

In such a conventional refrigerator, the cleaning of a tube of a condenser and/or an evaporator therein is carried out by switching the flowing direction of the cooling water (or hot water) and/or the flow direction of cool water to the condenser and/or evaporator, by means of a directional control valve, to reverse the fluid flow in the tube, thereby carrying out automatic movement of a cleaning brush received therewithin. Such automatic cleaning of the tube is smoothly accomplished because the flow velocity of cooling water (or hot water) or fluid to be cooled such as cool water, is above the minimum flow velocity of fluid necessary to carry out automatic movement of the brush (hereinafter referred to as "limit flow velocity" or "limit flow velocity for automatic movement of the brush").

However, a recent refrigerator has been developed for the purpose of energy conservation, which has been constructed to effect the control of cooling water (or hot water) or cool water, as well as control of capacity of the refrigerator based upon the detected load of the refrigerator itself (e.g. the load of cool water such as the temperature of cool water during operation of the manufacture thereof, or the load of hot water such as the temperature of hot water from a condenser in a heat pump during the operation of preparing the hot water). More particularly, such a refrigerator is adapted to decrease the flow rate of the cooling water (or hot water) or cool water when the load is reduced. However, the refrigerator of such type which is adapted to control the flow rate of cooling water (or hot water) or cool water, entails the following problems or difficulties when automatic cleaning of a tube by automatic movement of a brush therein, is a to be carried out. One such difficulty is that the brush in the tube fails to automatically move when the flow velocity of cooling water (or hot water) or cool water within the tube is decreased below the limit flow velocity for the automatic movement of the brush, thereby rendering cleaning of the tube virtually impossible.

Another difficulty is that stagnation of the brush within the tube due to clogging causes deterioration of heat transfer, resulting in a surging phenomenon in a centrifugal refrigerator, or in a high pressured trip due to condensation. Such a problem is also caused depending upon operating conditions during switching of the flow direction within the tube, because the flow rate of cooling water in the tube instantaneously reaches zero during the flow directional change. For example, this problem occurs under conditions where the capacity of the refrigerator and the internal pressure of the condenser are increased, during the switching of the flow direction.

A further problem is that there is a danger that cool water could become frozen due to a temperature drop within the cool water when the brush is clogged therewithin, thus causing the cool water to stagnate within the tube.

A still further problem is that because the flow rate of cool water instantaneously reaches zero as noted above, there is a danger that cool water could become frozen depending upon operating conditions during the flow directional switching and depending upon the temperature of the cooling medium itself within the evaporator, that cools the fluid to be cooled, such as the cool water.

SUMMARY OF THE INVENTION

Accordingly, it is an object of the present invention to eliminate the foregoing disadvantages of the prior art.

It is also an object of the present invention to provide a system and method for controlling the flow rate of fluid within a tube of a heat exchanger, for increasing the flow rate therein above a minimum flow velocity required for automatic movement of the brush therethrough.

It is another object of the present invention to provide a system and method for controlling flow rate of fluid in a tube of a heat exchanger, for increasing the flow rate of fluid therewithin to prevent jamming or stagnation of a brush within the tube of the heat exchanger, and to prevent any difficulties or breakdowns that might be caused by such jamming of a cleaning brush within a tube of a heat exchanger.

It is still another object of the present invention to provide a system and apparatus for controlling the flow rate of fluid within a tube of a heat exchanger, whereby flow rates of respective fluid streams within a refrigerator, such as the flow rate of cooling water or hot water, or the flow rate of fluid to be cooled such as cool water therewithin, can be reliably controlled.

It is yet another object of the present invention, to prevent unwanted temperature drop and/or freezing of liquid medium flowing through a tube of a heat exchanger, such as in a refrigerator.

These and other objects are attained by the present invention which provides a system and method for controlling the flow rate of fluid within a tube of a heat exchanger, e.g. having directional control valve means for switching or reversing the flow direction of fluid through the tube, wherein the flow rate or flow velocity of the fluid within the tube is increased at or during the switching of the flow direction. This provides for automatic movement of a cleaning brush disposed in the tube, in order that cleaning of the interior of the tube can be effectively carried out.

In a particular aspect of the present invention, increase in the flow rate of fluid in the tube at or during the change in flow direction therewithin, is controlled to be below a predetermined level. In another aspect of the present invention, the heat exchanger comprises a condenser and/or an evaporator within a refrigerator, in which the flow rate of cooling water or hot water through the condenser, or the flow rate of cool water through the evaporator, can be controlled. The flow rate of the cooling water or the hot water, or the flow rate of the cool water, is increased when a directional control valve is operated, to switch the direction of flow thereof.

In a further aspect of the present invention, increase in flow rate of cooling water or hot water, or increase in flow rate of the cool water at or during the flow directional change, is controlled to permit flow velocity of the cooling water or hot water, or flow velocity of the cool water, to rise above the limit flow velocity for the automatic movement of the brush within the tube.

In yet another aspect of the present invention, increase in the flow rate of the cooling water or hot water at or during flow directional change of the same, is controlled based upon temperature of cooling or refrigeration medium within a condenser, pressure within the condenser, or the temperature of the cooling or hot water itself. In yet a further aspect of the present invention, increase in the flow rate of the cooling water or hot water during or at the alteration in flow direction of the same, is controlled within an increasable range to permit flow velocity of the cooling water or hot water to rise above the limit flow velocity for the automatic movement of the brush, to permit temperature of the cooling or refrigeration medium within the condenser to drop below a predetermined level, or to permit the pressure within the condenser to drop below a predetermined level. In still a further aspect of the present invention, increase in flow rate of cool water within the evaporator during the alteration in the flow direction thereof, is controlled based upon the temperature or pressure of a cooling medium within the evaporator, or based upon the temperature of the cool water itself.

In still another aspect of the present invention, increase in flow rate of cool water at or during flow directional change is controlled within an increasable range to permit flow velocity of cool water to rise above the limit flow velocity for the automatic movement of the brush within a tube therein, and to permit the temperature of the cooling or refrigeration medium within the evaporator to drop below a predetermined level, or to permit the pressure within the evaporator to drop below a predetermined level.

Still other features, objects, and advantages of the present invention will become apparent from the following description.

BRIEF DESCRIPTION OF THE DRAWINGS

Accordingly, the present invention will be described in further detail below, which is not intended to limit the scope thereof in any way, by reference to the accompanying drawings, in which.

DETAILED DESCRIPTION OF THE PREFERRED EMBODIMENTS

Figure 1:
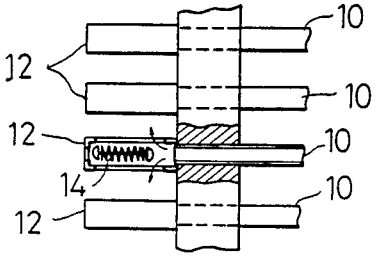
FIG. 1 is a schematic view illustrating the internal structure of a tube on the fluid discharge side of a heat exchanger, having a cleaning brush received therein.
Figure 2:
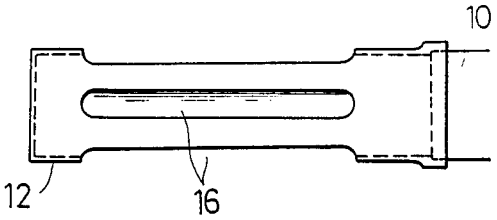
FIG. 2 is a schematic view illustrating a device or chamber for capturing and retaining a brush therein.

Referring to the Figures, FIGS. 1 and 2 illustrate a heat exchanger where a tube cleaning brush is received within a tube. FIG. 1 illustrates the internal structure of each of the tubes disposed along the fluid discharge side of a heat exchanger, while FIG. 2 is an enlarged view illustrating a brush receiving or capturing chamber. In FIGS. 1 and 2, heat exchanger tubes 10 each have brush receiving or capturing chambers 12 that are provided at both ends thereof. A tube cleaning brush 14 is adapted to be received within the brush receiving or capturing chamber 12 along the fluid discharge side thereof. The brush receiving or capturing chambers 12 are each formed with a fluid passage 16 having a slit-like shape.

When the flow of fluid supplied to the heat exchanger is switched or reversed by a directional control valve for switching the flow direction of fluid through the tube, the fluid is then directed in the direction opposite to the direction indicated by the arrows in FIG. 1. This results in fluid being introduced through the fluid passage or slit 16 and into the tube 10. This also causes the tube cleaning brush 14 to be transferred or automatically moved in the rightward direction of FIG. 1, to thereby effect brushing along the interior surface of the tube. The brush is then received in the appropriate brush-receiving or capturing chamber (not illustrated) disposed at the right end of the tube. This results in the inner surface of the tube 10 being cleaned, in order to maintain the heat exchanging capacity of the heat exchanger at or greater than a predetermined level. Switching of fluid flow is generally carried out about three times a day in certain cases, although it depends upon the fluid used for heat exchanging.

When the cleaning of a tube is carried out with a brush inserted into the tube as described above, the following relationship is established between the inner diameter $D_t$ of the tube and the diameter $D_b$ of the brush:

$$D_b = D_t + (0.2\ \text{mm} \sim 1.0\ \text{mm})$$

In such an instance, the limit flow velocity for automatic movement of the brush within the tube is empirically estimated to be about 1.0–1.5 m/sec, although it somewhat depends upon the hardness and/or density of the brush. The decrease in $D_b$ causes the limit flow velocity to be decreased, however, this does not exhibit the cleaning action.

When a heat exchanger is installed, a maximum flow velocity of fluid within a tube of the heat exchanger is limited to a level in light of the limit of horsepower of a motor used, and in light of erosion within the tube caused in relation to the flow velocity of fluid therewithin. When water is used the fluid, the flow velocity within the tube in light of the erosion within, is generally set depending upon annual operation time of the heat exchanger, as follows:

| Operation Time (hours) | Flow Velocity (m/sec) |
|---|---|
| <1500 | 3.6 |
| <2000 | 3.5 |
| <3000 | 3.3 |
| <4000 | 3.0 |
| <6000 | 2.7 |
| <6000 | 2.4 |

When corrosive fluid such as sea water or highly viscous fluid such as oil is used as the operating fluid, the flow velocity at each operational time is generally set lower than described above, in light of the corrosion resistance of the tube and the pressure loss within the tube.

When a heat exchanger is operated at each of the flow velocities described above, cleaning is accomplished by just operation of a directional control valve for switching the flow direction of fluid to the heat exchanger, because each flow rate is larger than 1.5 m/sec which is the above-described maximum value of the limit flow velocity for the automatic movement of the brush 14. However, the operating rate of the heat exchanger often causes the flow velocity of fluid flowing within the tube of the heat exchanger, to be 1.5 m/sec or less. This is also caused by the load of the heat exchanger when it is a refrigerator.

Accordingly, in such an instance, just the switching or reversing of flow direction of the fluid does not allow the flow velocity of the fluid to reach the limit flow velocity for the automatic movement of the brush. Such flow velocity of the fluid does not permit the brush to accomplish the cleaning of the tube, or actually causes the brush to block the tube, resulting in various difficulties such as enumerated above.

In view of the foregoing problems, the present invention is directed to detecting the flow velocity or rate of fluid in a tube of a heat exchanger at or during operation of a directional control valve for carrying out the switching or reversing of the flow direction of fluid therewithin, and to controlling or allowing the flow velocity of fluid to exceed the limit flow velocity for the automatic movement of a brush just before the switching or alteration in the flow, when the fluid flow velocity is below the limit flow velocity.

Figure 3:
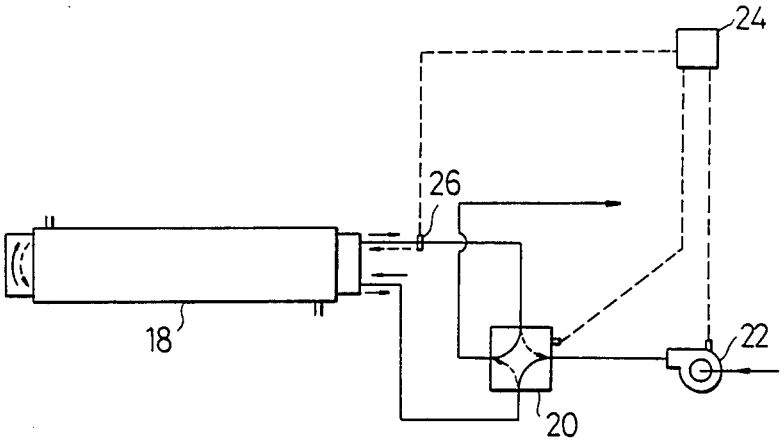
FIG. 3 is a flow diagram illustrating one embodiment of a system and method for controlling fluid flow within a tube of a heat exchanger, according to the present invention.

A system and method for controlling the flow rate of fluid within a tube of a heat exchanger according to the present invention will be described in connection with certain embodiments illustrated in the drawings. FIG. 3 illustrates one embodiment of a flow control system and method according to the present invention. A heat exchanger 18, a directional control valve 20, a variable pump 22, a controller 24, and a flow velocity detector 26 are all illustrated in FIG. 3.

In FIG. 3, if it is desired to change the direction of fluid flowing into a tube of the heat exchanger 18 that is fed into the heat exchanger in the direction indicated by the solid arrow through the variable pump 22, a switching command is supplied from a timer (not illustrated) incorporated into the controller 24, to the directional control valve 20 at a predetermined time. When this causes the valve 20 to operate, fluid then flows in the direction indicated by the dotted arrow. More particularly, fluid flowing into the tube then flows in a direction opposite to the direction prior to the switching or changeover, so that a brush received in a brush receiver chamber provided at one end of the tube in a manner as illustrated in FIG. 1, is then moved or transferred due to automatic movement together with the reverse movement of the fluid within the tube, while brushing the inner surface thereof. The brush is then received in a brush receiver or chamber provided at the opposite end of the tube, when the flow velocity of fluid within the tube is above the limit flow velocity for the automatic movement of the brush.

To the contrary, when the flow rate of fluid within the tube is below the limit flow velocity, the brush fails to move along the tube and is retained within the brush receiver at one end of the tube, or moves only part way or slightly along the tube and blocks the same. In this situation, cleaning of the tube is not accomplished.

In order to eliminate such a disadvantage, in the present invention the flow velocity detector 26 is provided for detecting the flow velocity of fluid within the tube. When the detector 26 senses that the flow velocity of fluid within the tube prior to activation of the directional control valve 20 is below the limit flow velocity, the detector 26 supplies a signal to the controller 24, on the basis of which the controller 24 generates a signal to the variable pump 22 which allows the rotational speed of the pump 22 to be increased, thereby increasing the flow velocity of the fluid above the limit flow velocity of the brush.

In this instance, it takes a short time for the pump 22 to carry out the response. Accordingly, it is preferable to increase the rotational speed of the pump about 10 seconds in advance to the activation of the flow path switching valve 20. Additionally, it is a matter of course that upon the lapse of the automatic movement time of the brush after the switching of the valve 20, control should be made which allows the flow rate of the fluid to be returned to the direction prior to the initial activation of the directional control valve 20.

Figure 4:
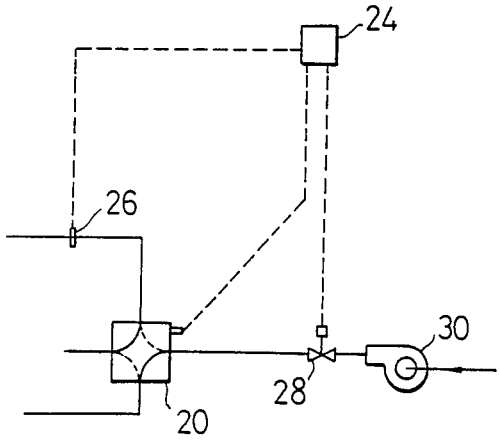
FIG. 4 is a schematic view illustrating a modification of the flow control system and method illustrated in FIG. 3.

Additionally, in the embodiment of the invention illustrated in FIG. 3, the variable pump 22 is provided for serving to vary the flow velocity of fluid depending upon the operating conditions. However, as illustrated in FIG. 4, the present invention may be modified in a manner to provide a flow control valve 28 on the discharge side of the pump 30. In such a situation, the flow control valve 28 is ordinarily disposed in a somewhat closed state, due to the flow limitation, and opened at the time of operation of the directional control valve 20 for increasing the flow velocity. The pump is indicated by numeral 30 in FIG. 4.

The above description principally refers to the situation where the flow velocity of fluid within the tube at or during the flow directional change, is below the limit flow velocity for automatic movement of the brush therewithin. However, a condenser of a refrigerator has a plurality of tubes disposed therewithin, with a brush received in each one of these respective tubes. Accordingly, in order to carry out the automatic movement of all the brushes within the tubes, it is desirable to increase the flow velocity of fluid therethrough such as cooling water as greatly as possible within the permissible horsepower of a motor used in a cooling water pump, or within a range of such flow velocity as described above even when the flow rate of cooling water is above the limit flow velocity of the brush. While one aspect of the present invention allows for increase in the flow rate of cooling water at or during the flow directional change, to be carried out just when the flow velocity of cooling water at or during the switching operation is below the limit flow velocity, other aspects of the present invention allow for such increase in the flow rate based upon other factors too.

Figure 5:
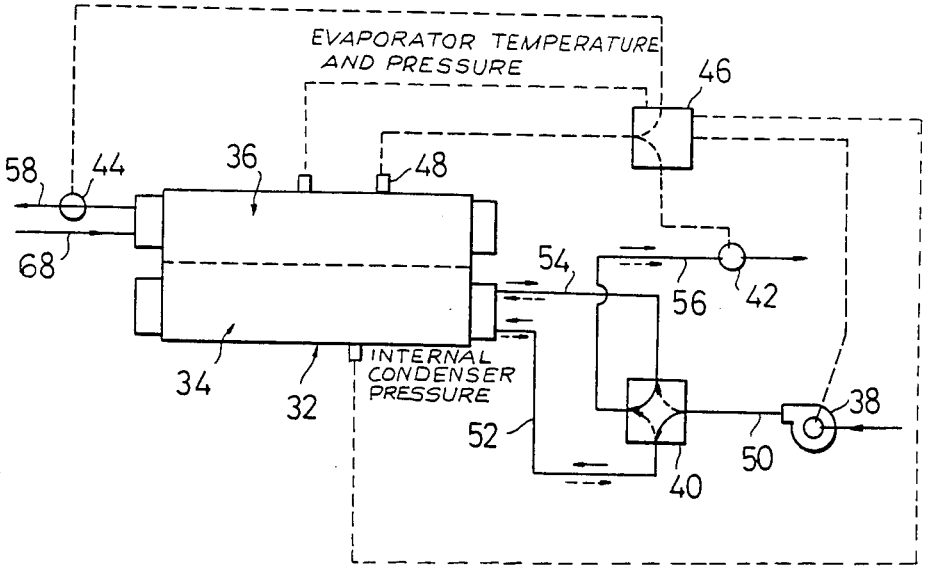
FIG. 5 is a schematic view illustrating another embodiment of a flow control system and method according to the present invention.

FIG. 5 illustrates another embodiment of a system and method for controlling the flow rate of fluid in a tube of a heat exchanger according to the present invention. The embodiment illustrated in FIG. 5 provides for adjusting the flow velocity or rate of cooling water in a refrigerator. More particularly, FIG. 5 is a schematic flow diagram illustrating control of the flow rate of cooling water in a centrifugal refrigerator using trichlorofluoromethane, or control of flow rate of hot water when a refrigerator is used for a heating pump cycle, together with the control of capacity of the refrigerator itself.

In FIG. 5, a refrigerator 32 includes a condenser 34 and an evaporator 36, with cooling water or hot water being supplied by pump 38 through directional control valve 40, for switching the flow direction of cooling water or hot water through the condenser. A detector 42 is provided for detecting the load of a heat pump, while a detector 44 is provided for detecting the load of water to be cooled such as cool water passing through the evaporator 36. A controller 46 is also provided, along with means 48 for controlling the capacity of the refrigerator 32.

Conduits 50, 52, 54, and 56 for the cooling water or hot water are provided, along with conduits 58 and 68 for the cool water. Solid line arrows in FIG. 5 indicate the direction of flow of cooling water or hot water prior to the switching of the flow direction thereof, while the dotted arrows indicate the flow direction of cooling water or hot water after the flow direction thereof has been switched.

The following description is in connection with operation of a refrigerator during an ordinary refrigerating cycle, with reference to FIG. 5. During the operation of the refrigerator 32, a signal generated from the detector 44 for detecting the load of cool water, is sent to the controller 46 to permit the controller 46 to generate a command depending upon the load of cool water. This command is then conveyed to the refrigerator controlling mechanism 48 which controls, based upon the command issued from the controller 46, not only the capacity or output of the refrigerator 32, but also the rotating speed of the cooling water pump 38, to thereby control the flow rate of the cooling water as well.

More particularly, when, for example, the load of cool water is decreased, the refrigerator controlling mechanism 48 is adapted to carry out control in a manner for reducing the capacity of the refrigerator, and for decrease of the flow rate of the cooling water. Furthermore, in the illustrated embodiment, when a command for switching the flow direction of cooling water is generated in order to carry out the cleaning of a tube arranged within the condenser 34 due to the automatic movement of a brush, the flow rate of cooling water is controlled based upon the flow velocity of the cooling water and the internal pressure within the condenser 34.

More specifically, in the illustrated embodiment, the flow rate of cooling water is increased within an increasable range to permit the flow velocity thereof to rise above the limit flow velocity, and to permit the pressure within the condenser to fall a predetermined level, when the flow velocity of cooling water within the tube is below the limit flow velocity at the time of generation of the switching command.

Figure 6:
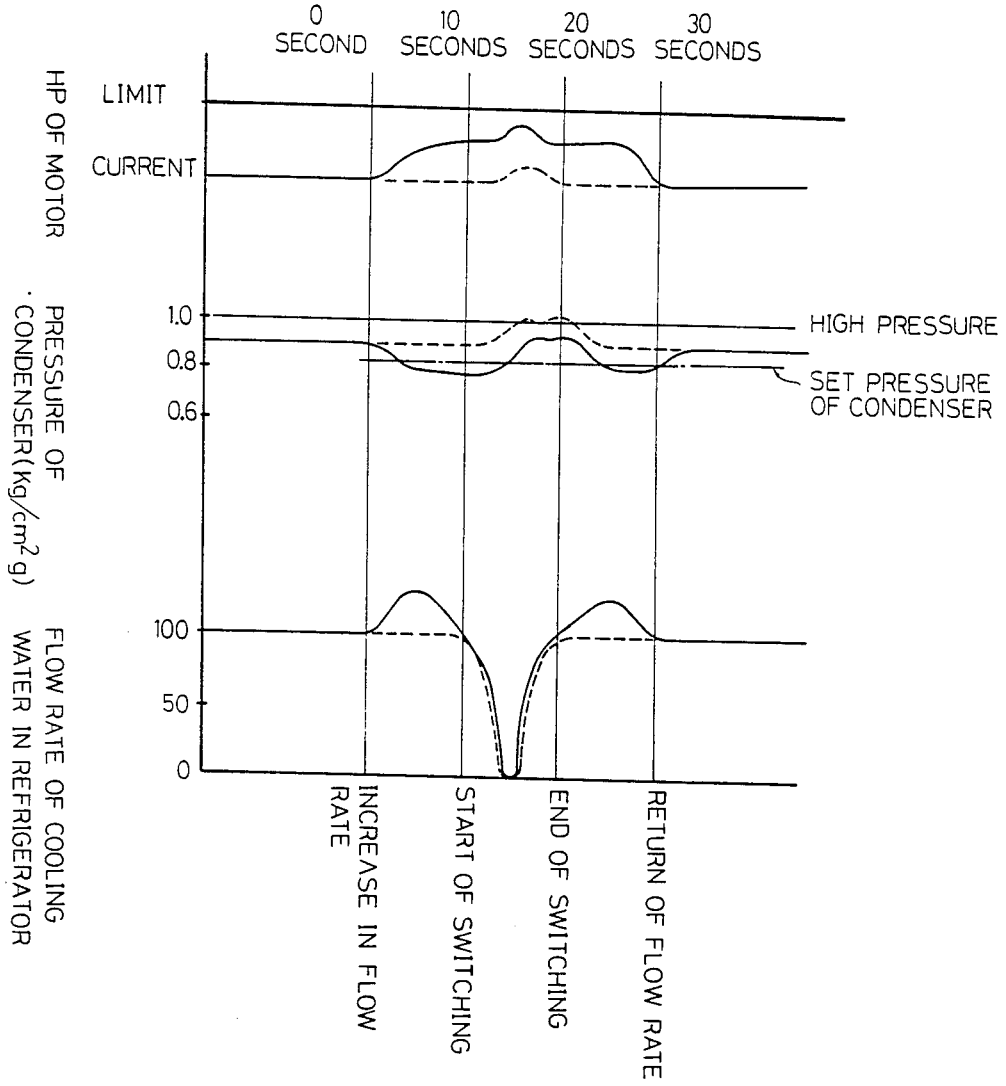
FIG. 6 is a graphical representation illustrating the relationship of control characteristics of the flow control system and method illustrated in FIG. 5.

An example of the manner of such control will be more specifically described with reference to FIG. 6 illustrating the control characteristics at or during the flow directional change. FIG. 6 illustrates the influence of the flow directional switching upon the horsepower (electrical current value) of a motor, the pressure of the condenser, and the flow rate of the cooling water in the refrigerator, when the flow rate of cooling water therewithin is assumed to be 100 before the switching is carried out. More specifically, the dotted lines in FIG. 6 indicate the relationships among the horsepower of the motor, the pressure of the condenser, and the flow rate of the cooling water within the refrigerator, that are attained when the control of the flow rate of cooling water is not carried out at or during the flow direction switching. The solid lines indicate such relationships attained when the flow rate of cooling water is controlled at or during the flow direction switching according to the present invention.

The control according to the present invention illustrated in FIG. 6 is carried out in such a manner that the rotating speed of the pump is increased 10 seconds in advance to the flow directional switch, utilizing a device for controlling the rotating speed of the pump to thereby increase the flow rate of cooling water. The so-increased flow rate of cooling water is returned, as initially, within ten seconds after the end of the flow direction switching. This causes the pressure of the condenser to be decreased by about 0.1 kg/cm$^2$ prior to the flow direction switching, resulting in the pressure of the condenser being maintained at a stable level with respect to the increase thereof at or during the flow directional switch.

In contrast, when the control of flow rate of cooling water is not carried out, the flow rate of the cooling water within the refrigerator is reduced to zero at or during the flow directional switch as indicated by the dotted lines in FIG. 6. This fails to result in cooling of the cooling or refrigerator medium within the condenser, and causes the condenser pressure to rise by 0.1 $kg/cm^2$ or more, to exceed a high pressure trip line, as indicated by the dotted line in FIG. 6.

In the above-described example of the control, the flow directional switching is carried out under the operating conditions where the load of the refrigerator is high and the pressure of the condenser is near the trip line. In order to carry out the flow directional switching under such operating conditions, control is required which allows the flow rate of cooling water to be increased within a range of the capacity of the motor, to prevent the pressure of the condenser from exceeding the trip line. This depends upon not only the flow rate of the cooling water prior to the flow directional switching, but also depends upon the pressure of the condenser prior thereto. However, when the cooling water has a low temperature, or the refrigerator has a low load and the condenser has a temperature, or pressure lower than a predetermined level, and sufficient to be on the safe side of the high pressure trip line or a surging limit, it is merely necessary to increase the flow rate of cooling water above the automatic moving velocity, i.e., the limit flow velocity of the brush (control according to the present invention may also be carried out based upon the temperature of the condenser, because such temperature corresponds to the pressure thereof). In other words, in such an instance, control can be carried out irrespective of the temperature or pressure of the condenser.

Furthermore, for the purpose of preventing the high pressure trip or surging, control may be carried out depending upon the temperature of the cooling water, instead of upon the pressure or temperature of the condenser. Additionally, the flow directional switching according to the present invention as described above, is also applicable to the situation where the refrigerator 32 is operated to obtain hot water or during a heating pump cycle, except that the control of the cooling water pump 38 and the capacity of the refrigerator 32 that is carried out based upon the load of cooling water sensed by the detector 44 illustrated in FIG. 5, is substituted with the control of capacity of the refrigerator 32 and the pump 38 based upon the load of the heat pump as sensed by the detector 42.

Figure 7:
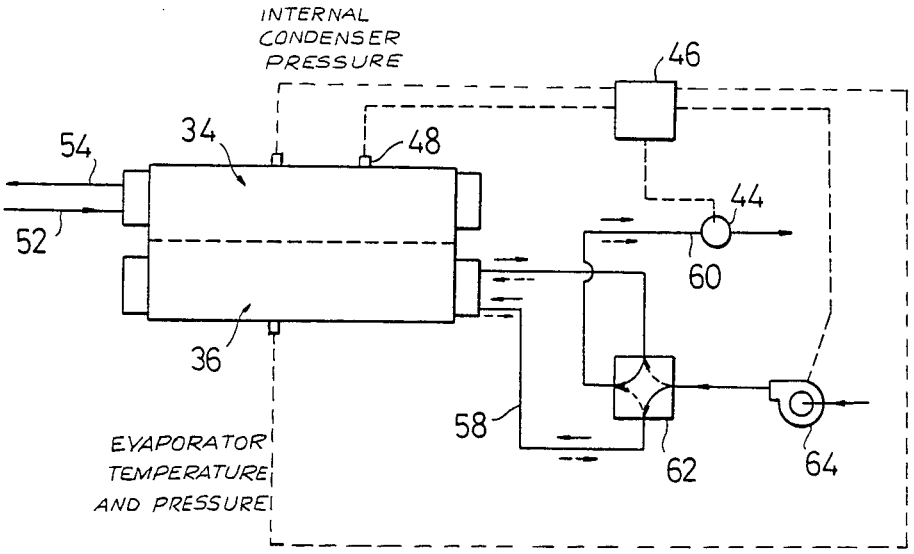
FIG. 7 is a schematic view illustrating a further embodiment of a flow control system and method according to the present invention.

Another embodiment of a flow control system and method for adjustably controlling the flow rate of cool water through a heat exchanger according to the present invention, is described below with reference to FIG. 7. Referring to FIG. 7, where similar parts to the embodiment of FIG. 5 are indicated by like reference numerals, a directional control valve 62 for switching the flow direction of cool water through an evaporator 36, and a cool water pump 64 are provided. Also, the solid arrows in FIG. 7 indicate the flow direction of cool water prior to the switching of the flow direction thereof, while the dotted arrows indicate the direction of cool water flow after the switching.

The flow control system and method illustrated in FIG. 7 is provided in a manner such that a signal generated from a detector 44 for detecting the load of cooled water 60 is conveyed to a controller 46. This in turn permits the controller 46 to generate a command (signal) depending upon the load of cool water 60 and based upon the signal of the detector 44. This command signal of the controller 46 is supplied to a mechanism 48 for controlling the capacity of the refrigerator 32, during the operation thereof, so that the capacity or output of the refrigerator 32 may be concomitantly controlled. The command (signal) generated from the controller 46 based upon the load of cool water 60 that is detected, also causes the rotational speed of the cool water pump 64 to be controlled, in order to control the flow rate of the cool water itself.

More particularly, the control is carried out in a manner to decrease the flow rate of cool water, as well as the capacity of the refrigerator 32, when the load of cool water is decreased, to thereby achieve energy conservation.

The flow control system and method of FIG. 7 is also provided for controlling the flow rate of cool water based upon the flow velocity of the same, and the temperature of cooling or refrigeration medium within the refrigerator, when a command for switching the flow direction of the cool water is generated in order to clean the interior of a tube disposed within the evaporator due to the automatic movement of a brush in the tube therein. More particularly, when the flow velocity of cool water within the tube is below the limit flow velocity for the automatic movement of the brush at the time when the flow direction switching command is generated, control is executed to increase the flow rate of cool water as greatly as possible within a range of the horsepower of a motor used for the cool water pump, so that the flow velocity of cool water may be permitted to rise above the limit flow velocity, and the temperature of the cool water within the evaporator may be prevented from decreasing below a safe level.

Figure 8:
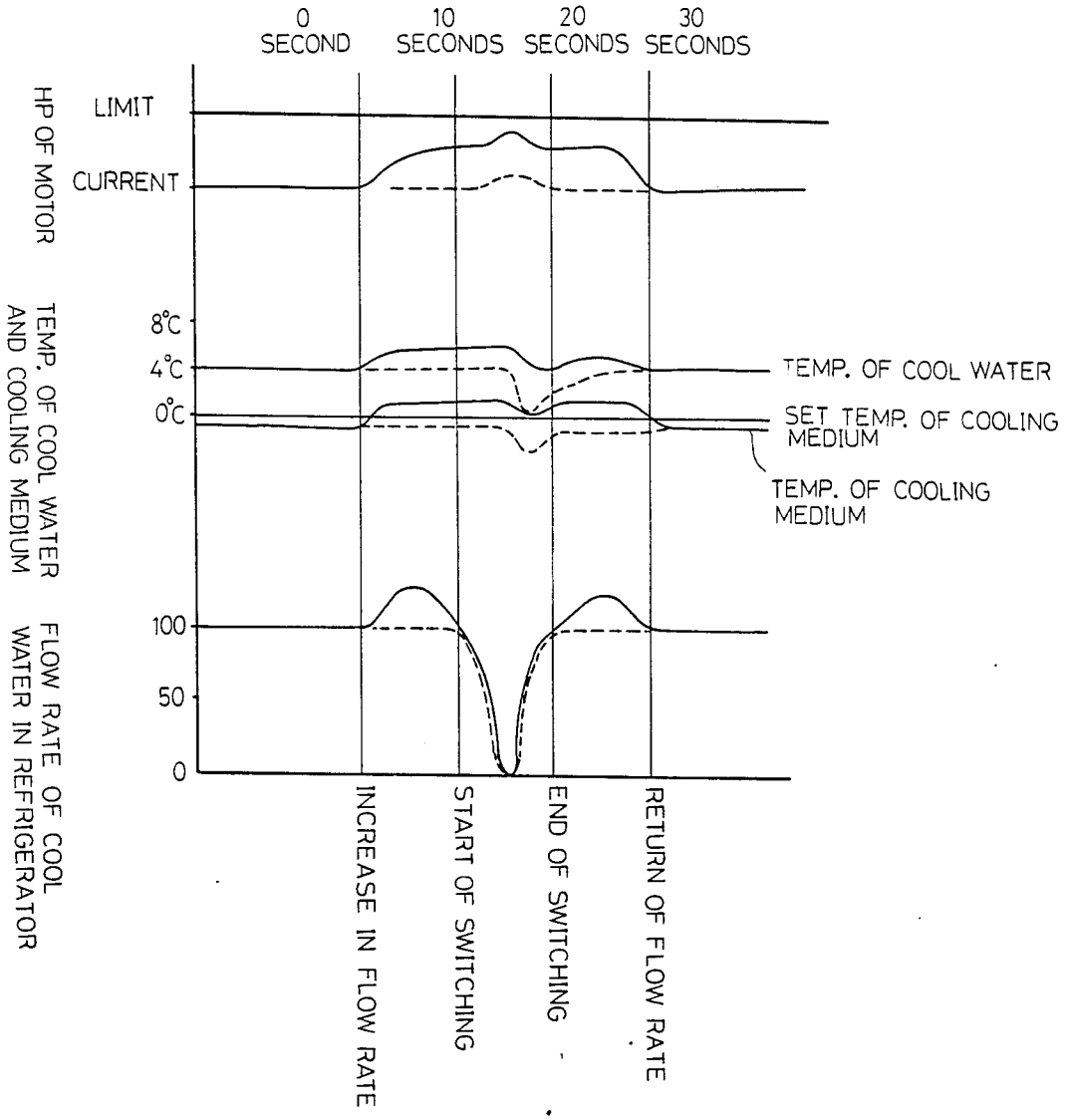
FIG. 8 is a graphical representation illustrating the control characteristics of the flow control system and method illustrated in FIG. 7.

The manner of such control will be described in further detail with reference to FIG. 8 which illustrates control characteristics at or during the switching of the flow direction of the cool water. FIG. 8 illustrates the influence of the switching of the flow direction of cool water upon four factors, namely the horsepower (electrical current value) of the motor, the temperature of the cool water, the temperature of the cooling medium, and the flow rate of cool water within the refrigerator (the relative value prior to the switching assumed to be 100). Additionally, the dotted lines in FIG. 7 indicate the relationships among the four above-mentioned factors that are attained when the control of flow rate of cool water is not carried out at or during the flow direction switching, while the solid lines indicate such relationships obtained when the flow rate of cool water is increased at or during the switching according to the present invention.

In the example of the manner of control according to the present invention illustrated in FIG. 8, the increase in the flow rate of cool water is carried out for a period of thirty seconds within the limit of the horsepower of the motor. More specifically, the control is carried out in the manner to increase the rotating speed of the pump, ten seconds prior to the switching of the flow direction, using a device for controlling the rotating speed of the pump, and for returning the flow rate of the cool water to the original direction within ten seconds after completion of the switching, as before. FIG. 8 clearly illustrates that the present invention permits the electrical current of the motor to be increased with the rotating speed thereof.

Additionally, FIG. 8 illustrates that the present invention allows the temperature of the cool water to be increased by about 2° C., or from 4° C. to 6° C., with the increase in flow rate thereof. Thus the temperature of the cool water during the switching operation will be restricted to a drop of only 4° C. Thus it is clearly seen that the present invention is capable of maintaining the temperature of the cool water at a safe level. In contrast, when the flow rate of the cool water is not increased, the temperature of the cool water drops to about 0° C. as indicated by the dotted line in FIG. 8. Thus, there is a great danger that the cool water will freeze. Furthermore, as illustrated in FIG. 8, the temperature of the cooling medium exhibits substantially the same behavior as that of the cool water. Control carried out only on the basis of the flow rate of cool water prior to the flow direction switching cannot eliminate such a danger, so it is necessary to exercise control based upon the temperature of the cooling medium as well.

The control characteristics illustrated in FIG. 8 are obtained when the control is carried out in a state where the load of the refrigerator is high. Thus the temperature of the cooling medium within the evaporator is rendered low. In contrast, when the load of the refrigerator is low and the temperature or pressure of the cooling medium is above a predetermined level, the temperature of the cool water is thus rendered high. In this instance, it is only necessary to increase the flow rate or velocity of cool water above the limit flow velocity for the automatic movement of the brush, because there is no danger that the cool water will freeze. In other words, in this instance, control may be carried out regardless of the temperature or pressure of the cooling medium.

Such control of the flow rate of the cool water which permits the temperature of the cool water to be maintained from dropping to 0° C. or below, may be carried out based on the temperature of the cool water, instead of on the temperature or pressure of the cooling medium as described above.

The preceding description is in conjunction with the control of flow velocity of the cooling water or the control of the flow velocity of the cool water. However, when a heat exchanger is disposed for control of both the flow rates of the cooling water and the cool water based upon the load of the refrigerator, the flow control system and method of the present invention may be provided with respect to both the cooling water system, and with respect to the cool water system at the same time.

Figure 9:
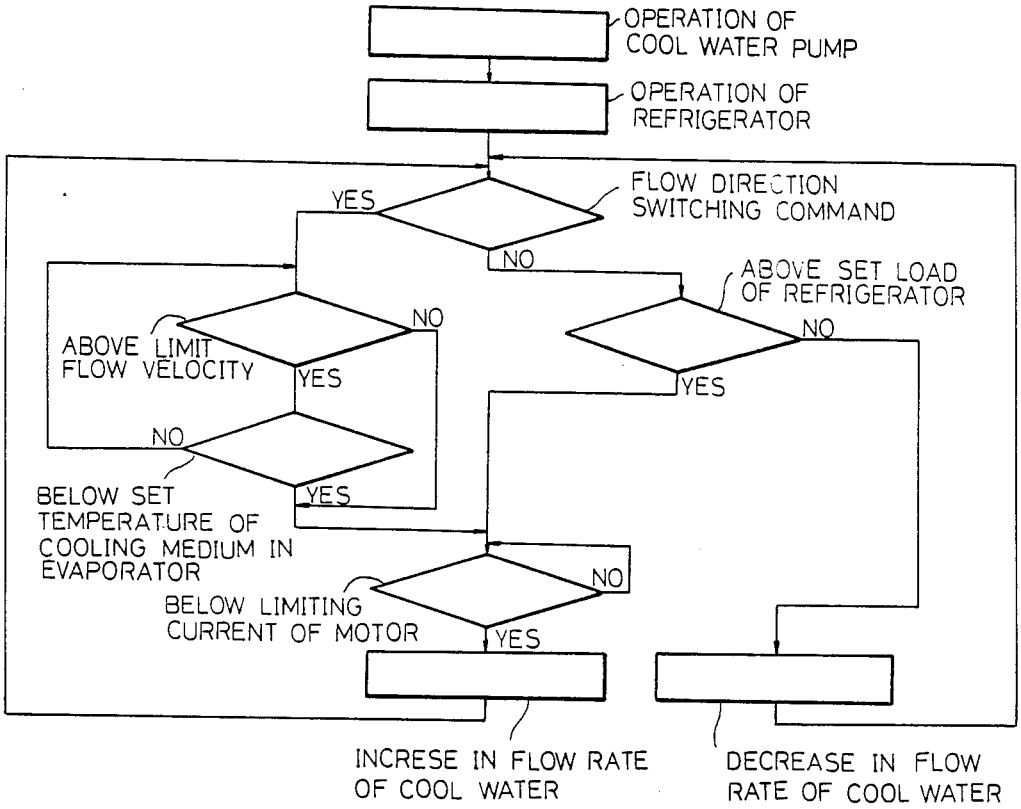
FIG. 9 is a block diagram illustrating one type of flow control carried out utilizing the flow control system and method of the present invention.

An example of control according to the control system and apparatus of the present invention will be described with reference to FIG. 9. Initially, detection of whether or not the load of a refrigerator is above a predetermined level, is carried out during operation of the refrigerator, even before a flow direction switching command is generated. When the refrigerator load is below the predetermined level, control is carried out to decrease the flow rate of the cool water. When the load is above this level, and the current of the motor is below the limiting current thereof, control is carried out to increase the flow rate of cool water. Then, when the flow direction switching command is generated, it is detected whether or not the flow velocity of the cool water is above the limit flow velocity for the brush.

When such flow velocity of the cool water is below the limit flow velocity, control is carried out to increase the flow velocity of the cool water in the situation where the current of the motor for the pump is below the limiting current thereof. Then the flow direction switching is carried out.

However, when the flow velocity of cool water is above the limit flow velocity for the brush, control depends upon whether or not the temperature of the cooling medium is below a predetermined temperature for the cooling medium. More particularly, control is carried out to increase the flow velocity of the cool water when the cooling medium temperature is below the predetermined level, with the flow direction switching then being subsequently carried out. When the cooling medium temperature is above the predetermined level, only the flow directional switching need be carried out.

Figure 10:
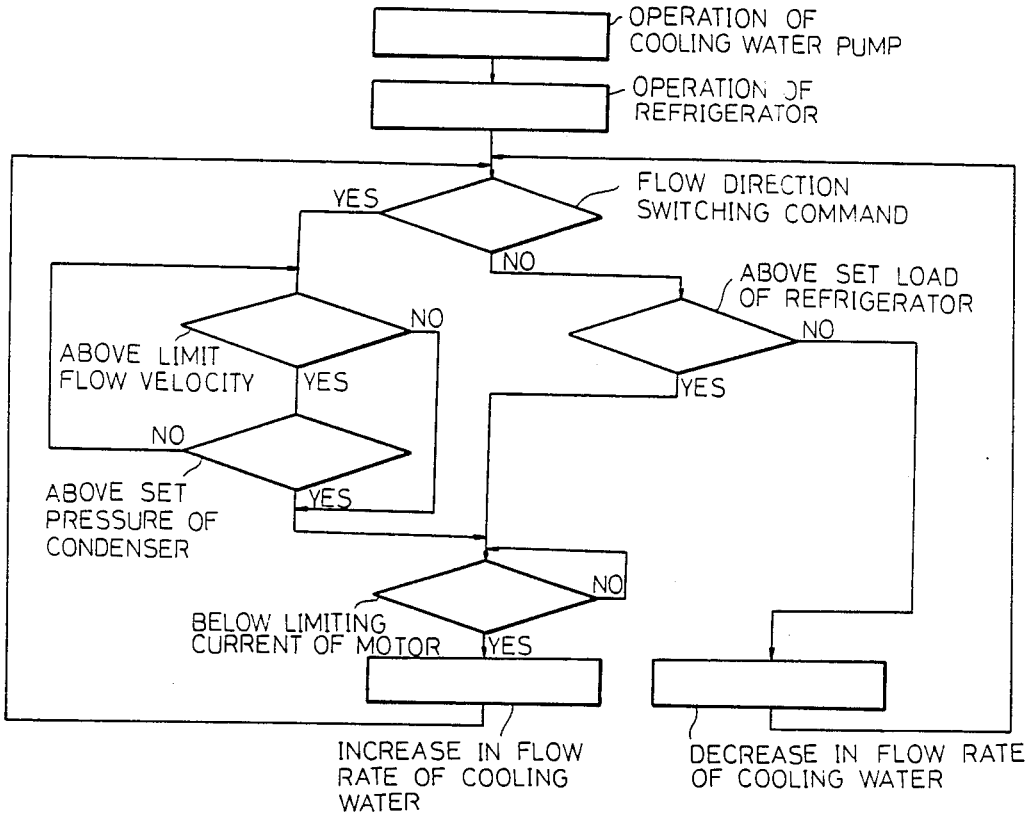
FIG. 10 is a block diagram illustrating another type of flow control carried out using the flow control system and method of the present invention.

FIG. 10 illustrates an example of the control according to the present invention for carrying out the flow direction switching of cooling water. It is readily noted that the control according to FIG. 10 is carried out in a substantially similar manner to the control illustrated in FIG. 9.

As clearly seen from the foregoing, the control system and method of the present invention can prevent a cleaning brush from blocking a tube, because the flow velocity of fluid therethrough is increased when such velocity is low. Additionally, the present invention effectively insures automatic movement of the brush within the tube during the cleaning thereof, such as in a refrigerator. The flow rate of cooling water and/or cool water therethrough, can be adjusted to thereby eliminate any problem of insufficient cleaning of the respective heat exchanger tubes.

Furthermore, the present invention can previously increase the flow rate of cooling water or hot water through a condenser to prevent the high pressure trip thereof during switching of the flow direction of the cooling water or hot water therethrough, and to prevent surging within a centrifugal refrigerator. This permits an automatically-moving cleaning brush to be effectively utilized within a cooling water system.

Additionally, the flow control system and method of the present invention can increase the flow rate of cool water within an evaporator to initially increase the temperature thereof prior to the switching of the flow direction, to thereby affirmatively eliminate any danger that the cool water could freeze during the switching of the flow direction thereof. This permits an automatically-movable cleaning brush to be effectively disposed within the cool water system, for the cleaning of the tube.

It is clearly seen that the objects set forth above, in addition to those made apparent from the preceding description, are effectively attained by the present invention. It is also clearly seen that certain changes and modifications may be made in the above embodiments of the present invention without departing from the spirit and scope thereof in any way. Thus it is intended that all disclosure contained in the above description, illustrated in conjunction with the accompanying drawings, is merely illustrative of the present invention and is not intended to be limiting thereof.

What is claimed is:

1. System for controlling flow rate of fluid within a heat exchanger tube, a cleaning brush being situated in the tube, comprising a circulation system for the fluid through the tube, switching means coupled into said circulation system for switching direction of the fluid flow through the tube, such that the brush moves through the tube to clean the same, and means coupled into said circulation system for increasing flow rate of the fluid through the tube prior to or during actuation of said switching means.

2. The system of claim 1 additionally comprising means for sensing the flow rate of the fluid within the tube, means for determining whether the sensed flow rate of the fluid is below a predetermined value, and wherein said increasing means constitute means for increasing the flow rate of the fluid when the flow rate is below the predetermined value prior to or when said switching means is actuated.

3. The system of claim 2, additionally comprising means for maintaining the increased fluid flow rate below a second predetermined value.

4. The system of claim 2, wherein the heat exchanger is constituted by at least one of an evaporator and a condenser within a refrigerator adapted to operate with one of a cooling and a heating cycle, said sensing means constitute means for sensing at least one of flow rate of first fluid through a condenser tube and flow rate of second fluid through an evaporator tube, said determing means constitute means for determing whether at least one of the sensed first and second fluid flow rates exceeds respective first and second predetermined values for the same, and wherein said increasing means constitute means for increasing at least one of the first and second fluid flow rates when the same is below the respective first or second predetermined value.

5. The system of claim 4, wherein said switching means also constitute means for moving the cleaning brush through at least one of the evaporator tube and the condenser tube, the respective first or second predetermined value constituting minimum flow velocity for moving the cleaning brush through the respective tube to clean the same.

6. The system of claim 1, wherein the heat exchanger is constituted by at least one of an evaporator and a condenser within a refrigerator adapted to operate with one of a cooling and a heating cycle, and additionally comprising means for sensing at least one of velocity of first fluid medium flowing through condenser tube, temperature of the flowing first fluid medium, internal pressure within the condenser, velocity of second fluid medium flowing through an evaporator tube, temperature within the evaporator, pressure within the evaporator, temperature of the second flowing fluid medium, and load within the refrigerator, means for determining whether the sensed value is below or above a respective predetermined value, and wherein said increasing means constitute means for increasing flow rate of respective fluid when the sensed value is above or below the respective predetermined value.

7. The system of claim 6, wherein said sensing means constitute means for sensing both flow velocity of the first fluid medium and for sensing the pressure within the condenser, said determining means constitute means for determining whether the sensed flow velocity of first fluid medium is below a first predetermined value and whether the sensed pressure within the condenser is above a second predetermined value, and said increasing means constitute means for increasing flow rate of the first fluid medium when the same is below the first predetermined value, and means for increasing the flow rate of the first fluid medium when the pressure within the condenser is above the second predetermined value, whereby pressure is stably maintained within the condenser.

8. The system of claim 6, wherein said sensing means constitute means for sensing at least one of flow velocity of the second fluid medium within the evaporator tube, temperature within the evaporator, pressure within the evaporator, and temperature of the second fluid medium, said increasing means constitute means for increasing flow rate of the second fluid medium when the same is below a first predetermined value, means for increasing the flow rate of the second fluid medium when the temperature within the evaporator is below a second predetermined value, and means for increasing the flow rate of the second fluid medium when the pressure within the evaporator is above a third predetermined value, said increasing means also constituting means for maintaining temperature of the second fluid medium within the evaporator tube above a certain level.

9. The system of claim 1, wherein said switching means comprise a directional control valve disposed in said circulation system.

10. The system of claim 1, wherein the heat exchanger tube constitutes an evaporator tube within an evaporator of a refrigerator, and additionally comprising means for sensing load of the fluid within the tube, and means for determining whether the sensed load is above or below a predetermined level, and wherein said increasing means constitute means for increasing flow rate of the fluid through the evaporator tube when the sensed load is above the predetermined level, and also constitute means for decreasing flow rate of the fluid through the evaporator tube when the sensed load is below the predetermined level.

11. The system of claim 1, wherein said increasing means comprise a pump disposed in said circulation system.

12. The system of claim 11, wherein said increasing means additionally comprise a flow control valve situated in said circulation system on a discharge side of said pump.

* * * * *